United States Patent [19]

Frazier

[11] 4,049,023

[45] Sept. 20, 1977

[54] STOP MOTION FOR NARROW WIDTH NEEDLE LOOMS

[75] Inventor: Robert Doyal Frazier, Rome, Ga.

[73] Assignee: Champion International Corporation, Stamford, Conn.

[21] Appl. No.: 689,870

[22] Filed: May 25, 1976

[51] Int. Cl.[2] ..... D03D 51/18

[52] U.S. Cl. ..... 139/339; 139/348

[58] Field of Search ..... 139/348, 339, 336, 370.1, 139/370.2, 431; 28/72.16

[56] References Cited

U.S. PATENT DOCUMENTS

| | | | |
|---|---|---|---|
| 2,471,845 | 5/1949 | Szabo et al. | 139/348 |
| 2,639,735 | 5/1953 | Fisher | 139/370.1 |
| 2,771,911 | 11/1956 | Holt | 139/339 |
| 3,200,853 | 8/1965 | Koyder et al. | 139/370.2 |
| 3,703,914 | 11/1972 | Freisler | 139/339 X |
| 3,851,680 | 12/1974 | Murray | 139/348 |
| 4,006,758 | 2/1977 | Libby | 139/431 X |

*Primary Examiner*—James Kee Chi

*Attorney, Agent, or Firm*—Evelyn M. Sommer

[57] ABSTRACT

A floating electrode is positioned in the nip between a pair of tape pull rollers on a needle loom for sensing the presence of excess yarn in the nip caused by improper winding of the tape on a take-up roll or a wrap around one of the pull rollers to an undue extent. Upon contact of the electrode by the excess yarn, the electrode is raised to contact a screw to establish an electric circuit to a relay to stop operation of the loom. The distance between the contact screw and electrode is adjustable by threading or unthreading the screw in its support to accommodate acceptable slack on the take-up roll and wrap around the pull roller.

4 Claims, 3 Drawing Figures

Fig. 1.
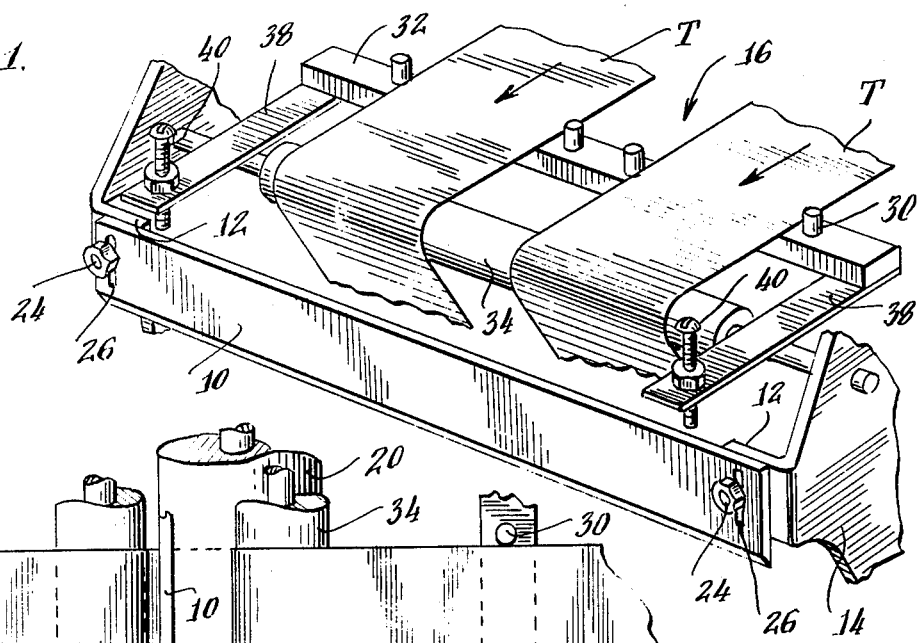
Fig. 2.
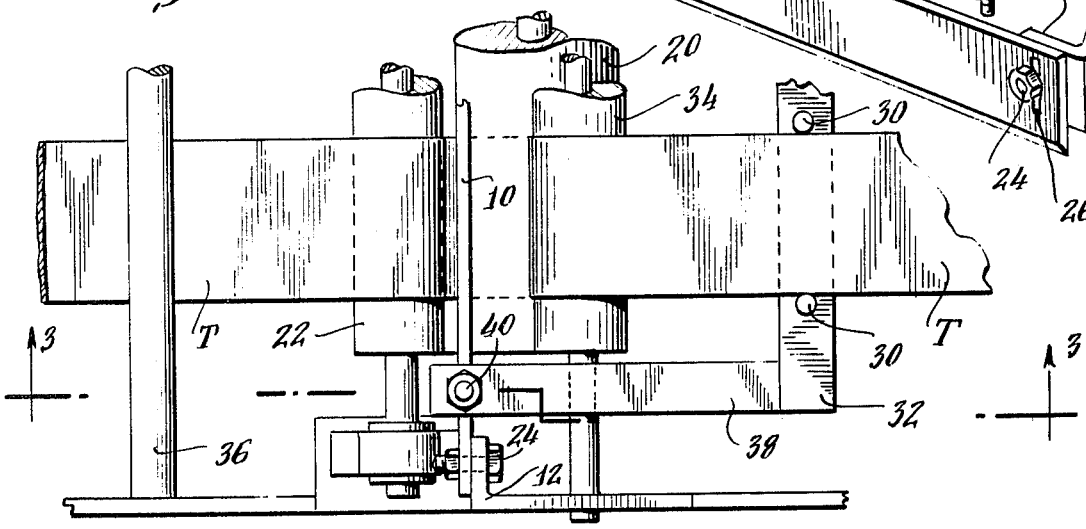
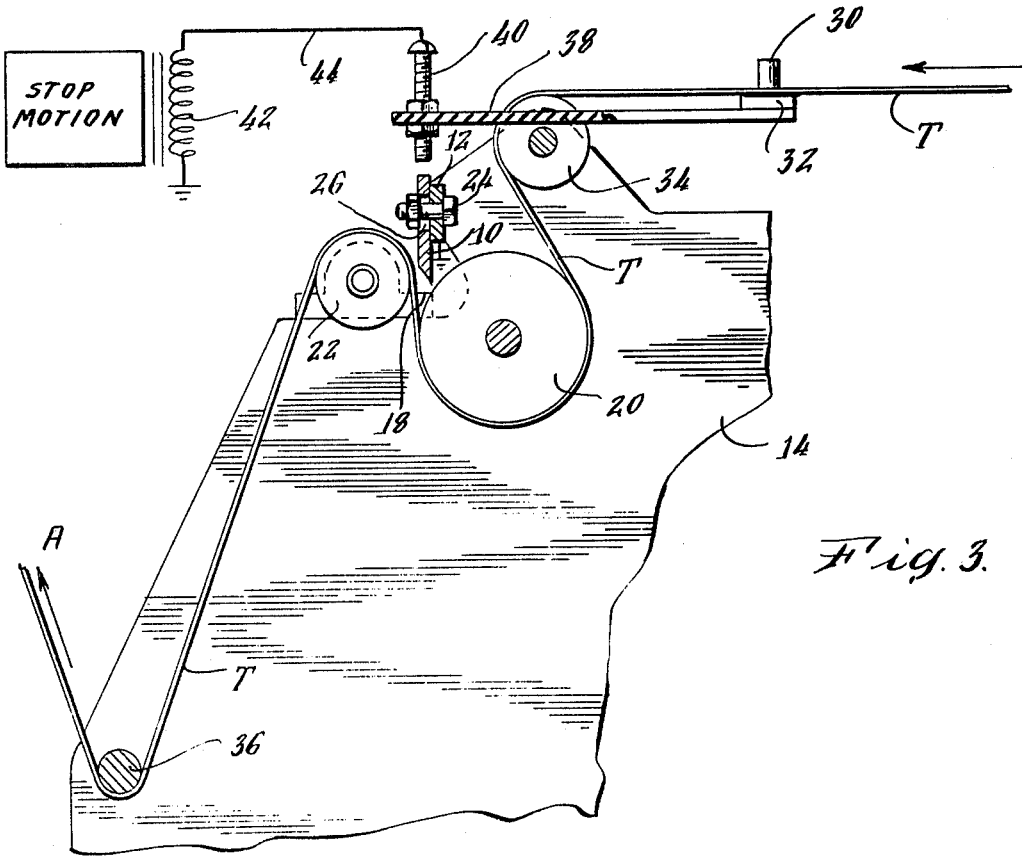
Fig. 3.

STOP MOTION FOR NARROW WIDTH NEEDLE LOOMS

BACKGROUND OF THE INVENTION

1. Field of the Invention

This invention relates to improvements in needle looms, and more particularly, to means for stopping the operation of the loom when a fabric tape is improperly wound on a take-up roll or wraps around a pull roll to an undue extent, so the condition can be corrected before an end of the tape breaks requiring rethreading and down-time of the loom, or before tape becomes wrapped around rolls to the extent that mechanical damage to the loom results.

2. Description of the Prior Art

Needle looms differ from shuttle looms in that the weft is inserted by a needle and knitted in a chain stitch along one side of a tape fabric including a plurality of warp threads in order that the weft can subsequently be removed after treatment of the fabric, e.g., by coloring, and the fabric unravelled to provide a yarn with intermittent coloring or splotches which is then rewoven. Such a process is commonly referred to as "weave-de-weave" and is described in detail in U.S. Pat. No. 3,605,225.

As a consequence, a shuttle loom operates at much slower speeds than a needle loom reversing direction through opposite sheds of the fabric so that the filling or weft is locked in on both edges of the tape by its return wrap around the selvage ends. Because of the high throughput of the needle loom, mechanical damage to the rollers and gear train of the loom and the fabric tape frequently occurs when an exit roller becomes wrapped by too slack a fabric tape being drawn away from the machine.

In the preparation of tapes for the weave-de-weave process, this problem is compounded by the wide pick spacing. A pick is one pass of the weft through the warp. This spacing is normally 0.5 – 2.0 inches, which reduces filling usage and also facilitates removal of the weft during deleasing, subsequent to coloring. Because of the high warp to filling ratio, the throughput of tape through a weave-de-weave loom is extremely high. That is, for every pick of filling across the tape, the tape advances through the machine 0.5 to 2.0 inches instead of distances on the order of 1/32 inch as in ordinary tape looms. Tape delivery through the loom can be as high as 50 – 75 yards per minute. At this high speed it is essential to have stop motions fitted to prevent wraps on rollers, since the greater throughput equates to larger roller wraps in much shorter time periods. There is also a need for a stop motion device that will shut off the machine before a warp end breaks, thereby reducing rethreading down-time.

U.S. Pat. Nos. 2,771,911 and 3,703,914 illustrates two forms of stop motion devices which have been used on looms heretofore. In U.S. Pat. No. 2,771,991, the stop motion includes a toggle switch having a free end pivotally disposed between a fabric guide roller and a sand roll about which the fabric is wrapped. Should the fabric wind completely about the sand roll, the toggle switch end in the nip between the rollers is contacted and the switch closed to stop the operation of the loom. Similarly, in U.S. Pat. No. 3,703,914, a pivoted bell-crank lever in the nip is pivoted by the fabric to close a circuit to stop the loom if improper winding in the nip is detected. However, these prior art stop motion devices do not have any degree of adjustability which is necessary in the higher speed narrower width, needle loom because of the increased throughput and variation in pick spacing.

SUMMARY OF THE INVENTION

In accordance with this invention, a bladeshaped electrode is reciprocably mounted on the frame of a needle loom in the nip of the tape pull rollers by bolts passing through vertical slots in the electrode that permit vertical movement. At the slightest appearance of excess yarn through the nip, either due to crowding between the rollers owing to the high throughput or the loss of proper tension by the tape removal roller, the electrode will be raised to contact a conductive stop in the form of a screw threadedly mounted on an insulator arm, to activate a common relay trip to stop the machine. The distance between the stop and electrode can be adjusted by merely threading or unthreading the screw on the insulator arm.

BRIEF DESCRIPTION OF THE DRAWING

Further objects and advantages of the invention will become apparent from the following description and claims and from the accompanying drawing, wherein:

FIG. 1 is a perspective view of the improved stop motion device of the present invention mounted on a narrow width needle loom;

FIG. 2 is a top plan view of the apparatus in FIG. 1; and

FIG. 3 is a cross-sectional view taken substantially along the plane indicated by line 3—3 of FIG. 2.

DETAILED DESCRIPTION OF THE PREFERRED EMBODIMENT

Referring now to the drawing in detail, wherein like numerals indicate like elements throughout the several views, the stop motion device of the present invention includes a blade-shaped electrode 10 reciprocally mounted on a pair of cross-arms 12 on the frame 14 of a narrow width needle loom 16 in the nip 18 of the tape pull rollers 20 and 22 by bolts 24 passing through vertical slots 26 in the electrode 10 that permit vertical movement.

One or more tapes T, consisting of plurality of warp threads and a continuous weft filling are passed between tape guide pins 30 on cross-bar 32 of frame 14, over a feed roller 34, around the tape pull rollers 20 and 22, and a direction change bar 36 to a take-up unit (not shown). A conductive stop in the form of a screw 40 is threadedly mounted on the end of an insulator arm 38 attached to each end of cross-bar 32 in spaced relation to the top of electrode 10. The distance between the end of each screw 40 and electrode 10 can be adjusted by merely threading or unthreading screw 40 on arm 32.

At the slightest appearance of excess yarn through the nip 18, either due to crowding between rollers 20 and 22 owing to the high throughput of needle loom 16 or the loss of proper tension at point A adjacent the tape removal units, the electrode 10 will be raised to contact either or both conductive stop screws 40 to establish a series circuit to a relay 42 to stop the operation of loom 16. As shown in FIG. 3, a wire 44 connects each screw 40 to complete the series circuit to relay 42.

The stop motion of the present invention will also stop operation of loom 16 in the event that a warp end of tape T draws tight and starts to break due to hanging from the creel, the difference in tension on the remote ends of the thread creating a pucker, whose loose loop also will raise electrode 10. In most instances, the loom 16 will stop prior to actual breakage of the yarn threads.

What is claimed is:

1. In a loom for forming a woven tape from yarn material and including a pair of woven tape pull rollers spaced to form a nip therebetween with the woven tape passed through the nip under tension and a stop motion device for stopping the loom when an excess of woven tape occurs in the nip such as with the commencement of a full wrap of woven tape around a tape pull roller the improvement including conductive electrode means reciprocally mounted on said loom in the nip between said tape pull rollers for sensing the presence of excess yarn in said nip through physical displacement thereby; and conductive stop means adjustably mounted on said loom in the path of the reciprocal motion of said electrode means for establishing an electric circuit to actuate said stop motion device and stop operation of said loom in response to contact by said electrode means .

2. The improved loom according to claim 1, said electrode means including a blade-shaped electrode having a plurality of vertical slots, and bolt means extending through said slots for mounting said electrode on said loom while enabling said blade-electrode to floatingly reciprocate along its vertical slots.

3. The improved loom according to claim 1, said stop means including an insulator arm connected to said loom, and a conductive screw threadedly connected to said arm and in series with said electric circuit, said screw having an end adjustable towards and away from said electrode means.

4. The improved loom according to claim 2 said stop means including a pair of spaced insulator arms connected to said loom, and a pair of conductive screws respectively and threadedly connected to said arms, said screws having each an end adjustable towards and away from said electrode means to sense said excess yarn over an extended width of the loom.

* * * * *